US011771952B2

(12) United States Patent
An

(10) Patent No.: US 11,771,952 B2
(45) Date of Patent: Oct. 3, 2023

(54) CHEST EXPANDER

(71) Applicant: GD IND Corp., Incheon (KR)

(72) Inventor: Tae Jin An, Incheon (KR)

(73) Assignee: GD IND Corp., Incheon (KR)

( * ) Notice: Subject to any disclaimer, the term of this patent is extended or adjusted under 35 U.S.C. 154(b) by 61 days.

(21) Appl. No.: 17/504,117

(22) Filed: Oct. 18, 2021

(65) Prior Publication Data

US 2022/0126166 A1 Apr. 28, 2022

(30) Foreign Application Priority Data

Oct. 27, 2020 (KR) ..... 10-2020-0140584

(51) Int. Cl.

| | |
|---|---|
| ***A63B 23/02*** | (2006.01) |
| ***A63B 21/05*** | (2006.01) |
| ***A63B 21/008*** | (2006.01) |
| ***A63B 23/12*** | (2006.01) |
| ***A63B 21/02*** | (2006.01) |

(52) U.S. Cl.

CPC ..... *A63B 23/02* (2013.01); *A63B 21/0083* (2013.01); *A63B 21/0087* (2013.01); *A63B 21/023* (2013.01); *A63B 21/05* (2013.01); *A63B 23/12* (2013.01); *A63B 23/1245* (2013.01);

(Continued)

(58) Field of Classification Search

CPC ..... A63B 21/0083; A63B 21/0087; A63B 21/0085; A63B 21/023; A63B 21/105; A63B 23/02; A63B 23/03533; A63B 23/03525; A63B 23/12; A63B 23/1245; A63B 23/1254

See application file for complete search history.

(56) References Cited

U.S. PATENT DOCUMENTS 4,629,186 A * 12/1986 Aldridge ..... A63B 21/4035 482/126
5,246,413 A * 9/1993 Koblick ..... A63B 21/0004 482/121

(Continued)

FOREIGN PATENT DOCUMENTS

CN 102139147 A 8/2011
CN 104853815 A 8/2015

(Continued)

OTHER PUBLICATIONS

Office Action issued in corresponding Chinese patent application 202111199174.1, dated Sep. 23, 2022 [6 pages].

(Continued)

*Primary Examiner* — Megan Anderson
(74) *Attorney, Agent, or Firm* — Osha Bergman Watanabe & Burton LLP

(57) ABSTRACT

Provided is a chest expander including a pair of operational arms having upper ends rotatably coupled to a head and moving to approach or be spaced apart from each other and a pair of gas springs disposed crosswise between the pair of operational arms. In the operational arm, a longitudinal hole configured to guide one end of the gas spring to move are formed. A guide coupled to the one end of the gas spring are arranged in the longitudinal holes. A Holding device holds the guide at a selected position. Intensity of elastic force provided by the gas spring is adjustable by adjusting a position of the one end of the gas spring.

9 Claims, 7 Drawing Sheets

(52) U.S. Cl.
CPC ..... *A63B 23/1254* (2013.01); *A63B 21/0085* (2013.01); *A63B 2225/09* (2013.01)

(56) References Cited

U.S. PATENT DOCUMENTS

| | | | | | |
|---|---|---|---|---|---|
| 5,613,928 | A * | 3/1997 | Laudone | A63B 23/03533 | 482/99 |
| 6,387,024 | B1 * | 5/2002 | Monti | A63B 23/03525 | 482/130 |
| 7,789,815 | B2 * | 9/2010 | An | A63B 23/03533 | 482/126 |
| 7,837,598 | B1 * | 11/2010 | Boozel, Jr. | A63B 23/03525 | 482/38 |
| 9,962,571 | B2 * | 5/2018 | Dennis | A63B 21/02 | |
| 11,458,359 | B2 * | 10/2022 | An | A63B 23/1209 | |
| 2020/0376333 | A1 | 12/2020 | An | | |

FOREIGN PATENT DOCUMENTS

| | | | |
|---|---|---|---|
| CN | 112007319 | A | 12/2020 |
| KR | 20010000301 | A | 1/2001 |
| KR | 200236803 | Y1 | 10/2001 |
| KR | 100673581 | B1 | 1/2007 |
| KR | 20070006256 | A | 1/2007 |
| KR | 101355679 | B1 | 2/2014 |
| KR | 101576738 | B1 | 12/2015 |

OTHER PUBLICATIONS

Office Action issued in corresponding KR Application No. 10-2020-0140584 dated Jul. 11, 2022 (6 pages).

* cited by examiner

CHEST EXPANDER

CROSS-REFERENCE TO RELATED APPLICATION

This application claims priority to and the benefit of Korean Patent Application No. 2020-0140584, filed on Oct. 27, 2020, the disclosure of which is incorporated herein by reference in its entirety.

BACKGROUND

1. Field of the Invention

The present invention relates to a chest expander, and more particularly, to a chest expander including a pair of operational arms and a pair of gas springs and in which intensity of elastic force provided by the gas springs is adjusted.

2. Discussion of Related Art

Generally, a chest expander is an exercise equipment used for training muscular strength of arms, shoulders, and the like and includes a head on which springs are installed and includes a pair of operational arms operationally connected to the springs.

A user grips left and right operational arms of the chest expander with both hands and then applies a force to both operational arms to approach each other so as to give muscular strength to arms, shoulders, and the like and returns the operational arms to original spaced positions by releasing the force to relax the muscular strength of the arms, shoulders, and the like so as to exercise through repeating the above motions.

However, a conventional chest expander has a problem of being incapable of adjusting intensity of elastic force provided to a chest expander according to user's muscular strength. Accordingly, it is necessary to use different chest expanders according to intensity of elastic force.

Meanwhile, Korean Patent Registration No. 1576738 discloses a chest expander including a means capable of adjusting intensity of elastic force provided to the chest expander in a head to which a pair of operational arms is rotatably connected.

SUMMARY OF THE INVENTION

The present invention is directed to providing a chest expander configured to be capable of adjusting intensity of elastic force provided by gas springs so as to allow a user to do a physical exercise with the intensity of elastic force adjusted suitably for user's muscular strength.

The present invention is directed to providing a chest expander including a pair of operational arms and a pair of gas springs in which positions of one ends of the gas springs can be adjusted to adjust intensity of elastic force provided by the gas springs in physical exercise.

According to an aspect of the present invention, there is provided a chest expander including a head, a pair of operational arms having upper ends coupled to the head by rotational shafts and configured to move to approach or be spaced apart from each other, a pair of gas springs disposed crosswise between the pair of operational arms and configured to provide elastic force in a direction in which the pair of operational arms are spaced apart from each other, a longitudinal hole formed in each operational arm to guide one end of the gas spring to move along a longitudinal direction of the operational arm, a guide coupled to the one end of the gas spring and configured to be movable along the longitudinal hole, and a holding device configured to hold the guide at selected position in the longitudinal hole. Here, intensity of elastic force provided by the gas spring is adjusted by adjusting position of the one end of the gas spring by moving the guide along the longitudinal hole.

Tooth-shaped portions may be formed on an outer circumferential surface of the upper end of the operational arm, and such tooth-shaped portions of the pair of operational arms may be arranged to rotate while being engaged with each other.

The longitudinal hole may be formed along rotational path of the one end of the gas spring around the other end of the gas springs while the gas springs are in a released state.

Sawteeth may be formed on an outer surface of the operational arm which correspond to the longitudinal hole. Also, the holding device may include a support plates arranged to be movable along the operational arms and connected to the guide, a pole arranged on the support plate, including a contact portion engaged with the sawteeth, and configured to be movable between an engagement position at which the contact portion is engaged with the sawteeth and a disengagement position at which the contact portion is detached from the sawteeth, and an elastic support member arranged on the support plate and configured to elastically support the pole to retain the pole at the engagement positions.

The sawteeth may be formed to be ratchet sawteeth tilted in one direction and configured to allow the pole to move in one direction while the pole are supported at the engagement position by the elastic support member.

A first shaft on which the pole are rotatably coupled and a second shaft on which the elastic support member is rotatably coupled may be provided on the support plate. The pole may include a contact surface, with which an end of the elastic support member comes into contact, on a surface facing the elastic support member. Also, the elastic support member may rotate in accordance with rotation of the pole and a direction in which the end of the elastic support member pressurizes the contact surface of the pole may be changed so that the pole may be supported at the engagement position and the disengagement position by the elastic support member.

The pole may include a rotational knob configured to rotate the pole between the engagement position and the disengagement position.

The elastic support member may include a shaft connection portion rotatably coupled on the second shaft, a contact support portion arranged to be movable in a longitudinal direction with respect to the shaft connection portion and having an end coming into contact with the contact surface of the pole, and a spring disposed between the contact support portion and the shaft connection portion.

A rotation limitation hole configured to limit rotation of the elastic support member within a set range may be formed in the support plate. A portion of the elastic support member may protrude through the rotation limitation hole, and the rotation limitation hole may interfere with the portion of the elastic support member and guide the elastic support member to rotate within the set rotation range.

BRIEF DESCRIPTION OF THE DRAWINGS

The above and other objects, features and advantages of the present invention will become more apparent to those of ordinary skill in the art by describing exemplary embodiments thereof in detail with reference to the accompanying drawings, in which.

DETAILED DESCRIPTION OF EXEMPLARY EMBODIMENTS

Figure 1:
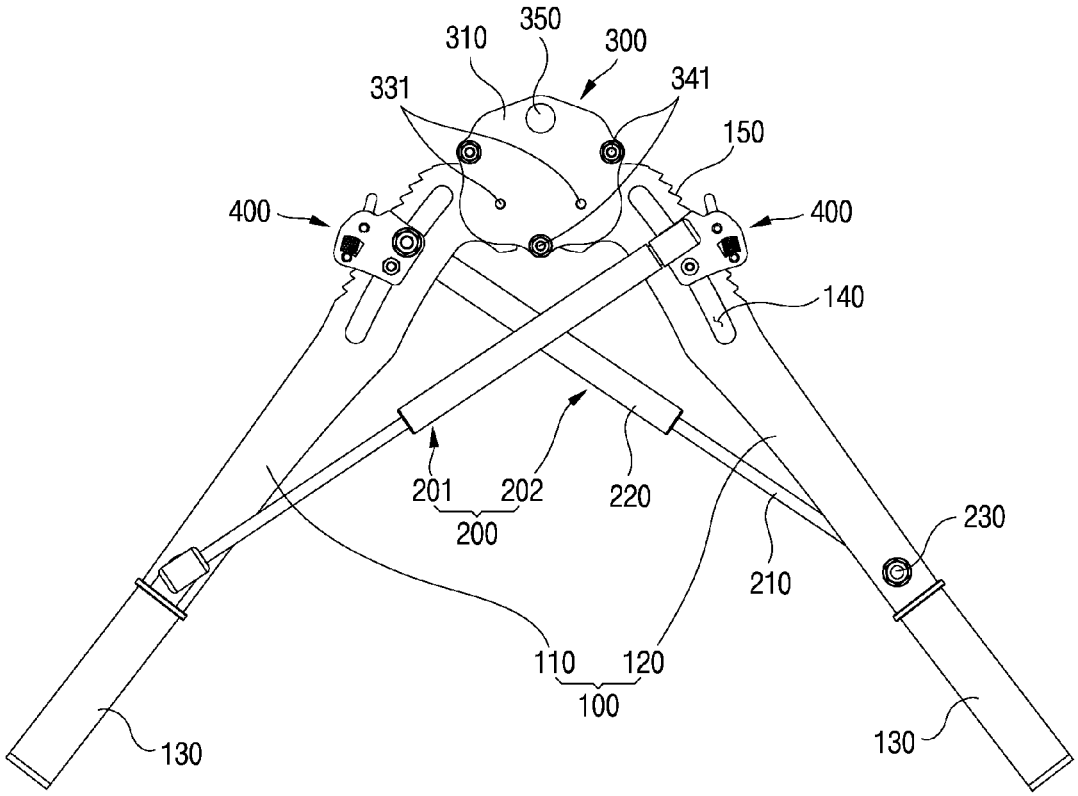
FIG. 1 is a front view illustrating a chest expander according to the present invention.

Since the present invention may be variously modified and have a variety of forms, particular embodiments will be described in detail in the text. However, these are not intended to limit the present invention to a particularly disclosed form and it should be understood that the present invention includes all changes, equivalents, and substitutes included within the concept and technical scope of the present invention. In a description on each drawing, like elements will be referred to as like reference numerals.

The terms are used only for distinguishing one component from another. The terms used herein are used merely for describing particular embodiments and are not intended to limit the present invention. Singular expressions, unless clearly defined otherwise in context, include plural expressions.

Figure 2:
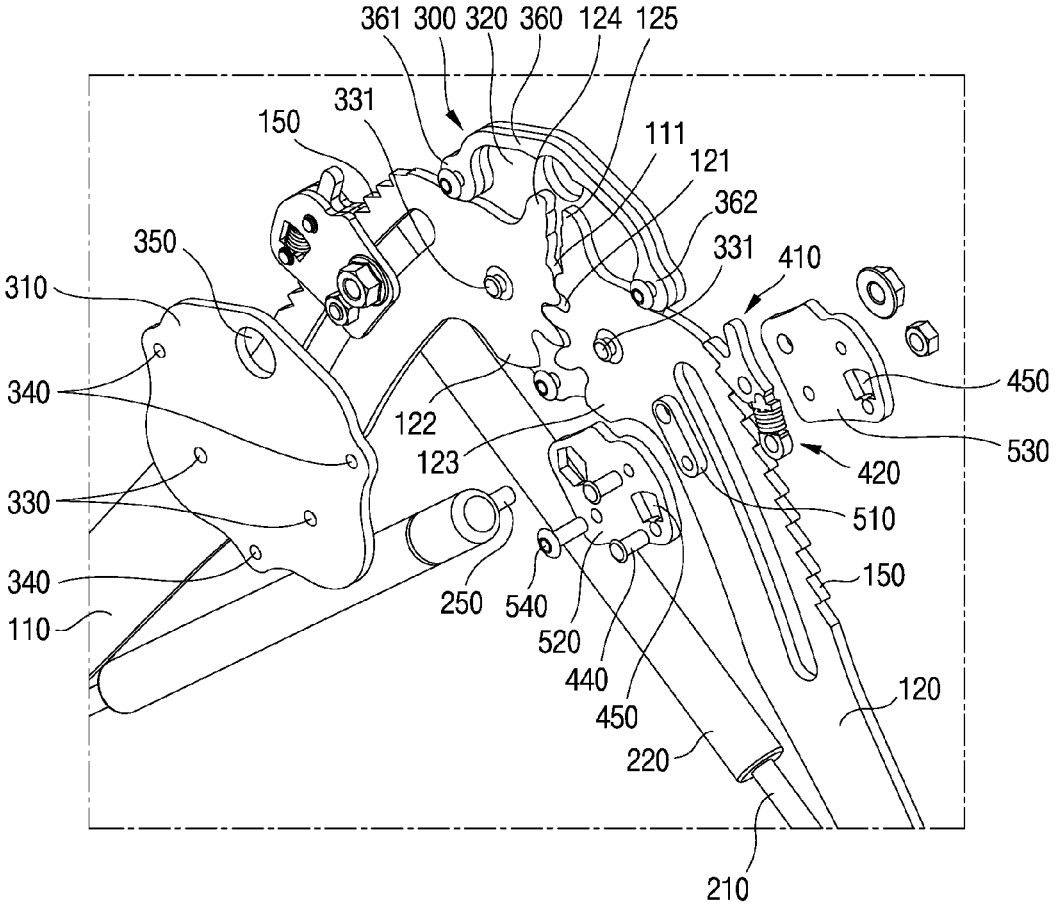
FIG. 2 is an exploded perspective view illustrating the chest expander according to the present invention.
Figure 3:
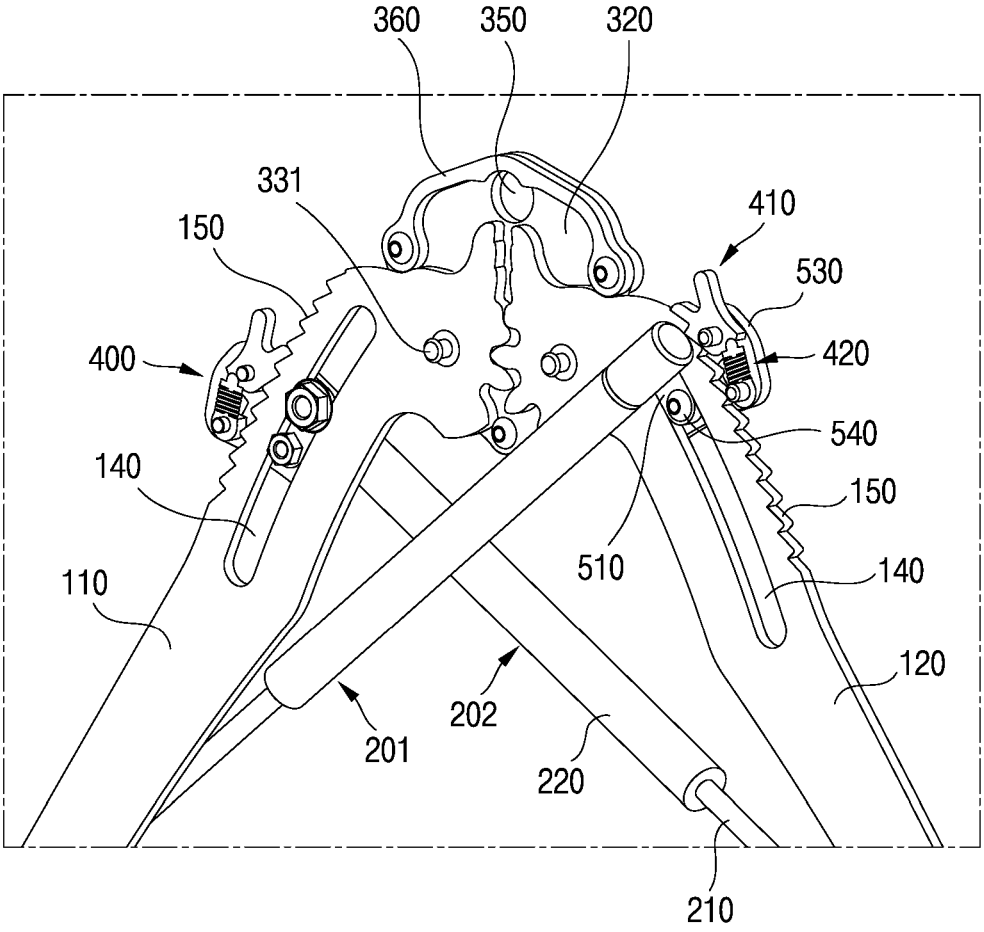
FIG. 3 is a partial exploded perspective view illustrating the chest expander according to the present invention.

FIG. 1 is a front view illustrating a chest expander according to the present invention, FIG. 2 is an exploded perspective view illustrating the chest expander according to the present invention, and FIG. 3 is a partial exploded perspective view illustrating the chest expander according to the present invention.

The chest expander according to the present invention includes a pair of operational arms 100, a pair of gas springs 200, and a head 300 configured to support the pair of operational arms 100 to approach and be spaced apart from each other.

The pair of operational arms 100 includes one operational arm 110 and the other operational arm 120 which are pivotably coupled to the head 300 and move to be spaced apart from or approach each other. The operational arms 100 each include a handle 130 at a lower part to be grippable by a user. In the specification, reference numeral 100 refers to operational arms representatively, and reference numerals 110 and 120 are used to distinguish one operational arm and the other operational arm from each other.

Longitudinal holes 140 configured to guide movement of upper ends of gas springs 200 are formed in the operational arms 100. The longitudinal holes 140 allow elastic forces provided by the gas springs 200 to be adjustable by adjusting positions of the upper ends of the gas springs 200. The longitudinal holes 140 are formed along a longitudinal direction from upper parts of the operational arms 100 and formed along rotational paths of the upper ends around pivoting shafts 230 configured to support lower ends of the gas springs 200.

The upper ends of the operational arms 100 are rotatably coupled to the head 300 by rotational shafts 331. Tooth-shaped portions 111 and 121 which are engaged with each other are formed on the upper ends of the operational arms 100. Since the tooth-shaped portion 111 of the one operational arm 110 and the tooth-shaped portion 121 of the other operational arm 120 are engaged with each other, the one operational arm 110 and the other operational arm 120 rotate symmetrically. Since the operational arms 100 move while being symmetrical to each other on the basis of a central axis of the chest expander, it is possible to do a balanced muscular strength exercise. Components of the upper ends of the operational arms 100 will be described in detail below in relation to the head 300.

The pair of gas springs 200 is disposed to alternate between the pair of operational arms 100. One gas spring 201 is disposed in front of the chest expander so that a lower end thereof is coupled to the one operational arm 110 and an upper end thereof is coupled to the other operational arm 120. The other gas spring 202 is disposed in the rear of the chest expander so that a lower end thereof is coupled to the other operational arm 120 and an upper end thereof is coupled to the one operational arm 110. The lower ends of the gas springs 200 are rotatably coupled to the operational arms 100 through the pivoting shafts 230. In the specification, reference numeral 200 refers to the gas springs representatively, and reference numerals 201 and 202 are used for distinguishing the one gas spring and the other gas spring from each other.

The gas springs 200 provide elastic forces in a direction in which the one operational arm 110 and the other operational arm 120 are to be spaced apart from each other due to compressive deformation of length contraction when they approach each other. The gas springs 200 each include a rod 210 and a tube 220 to which the rod 210 is movably coupled. The gas springs 200 provide elastic forces using volume variation caused by compression of gases inside the tubes 220 according to movement of the rods 210.

The upper ends of the gas springs 200 are movably installed along the longitudinal holes 140 of the operational arms 100, and the lower ends thereof are rotatably coupled by the pivoting shafts 230. Accordingly, the gas springs 200 rotate around the pivoting shafts 230 and the upper ends thereof are movable along the longitudinal holes 140.

The longitudinal holes 140 are formed corresponding to the rotational paths of the upper ends around the pivoting shafts 230 of the gas springs 200 which are in a released state. Accordingly, when the gas springs 200 are in the released state, the upper ends of the gas springs 200 may be easily moved along the longitudinal holes 140. The released state of the gas springs 200 means a state in which the gas springs 200 are tense in an incompressible state. Since the gas springs 200 reaches the released state without forces applied to the gas springs 200 through the operational arms 100, the released state of the gas springs 200 corresponds to a no-load state.

The head 300 rotatably supports the upper ends of the operational arms 100.

As shown in FIG. 2, the operational arms 100 are coupled to the head 300 using a method of coupling the upper ends of the one operational arm 110 and the other operational arm 120 to be rotatable around the rotational shafts 331 while facing each other.

The head 300 includes a front plate 310 and a rear plate 320 and includes an installation space formed therebetween. The upper ends of the operational arms 100 are disposed in the installation space. Shaft insertion holes 330 into which the rotational shafts 331 are inserted and fastening holes 340 to which fastening members 341 such as bolts and the like are fastened are formed in the front plate 310 and the rear plate 320 which form the head 300.

A catch hole 350 is formed in the head 300. Through the catch hole 350 formed passing through the front plate 310 and the rear plate 320, the user may accommodate the chest expander by hanging the chest expander on a hook or the like attached to a wall.

The tooth-shaped portions 111 and 121 including gear teeth are provided on outer circumferential surfaces of the upper ends of the one operational arm 110 and the other operational arm 120 which are coupled to the head 300. Since the operational arms 100 are installed so that the tooth-shaped portions 111 and 121 are engaged with each other, movements of the one operational arm 110 and the other operational arm 120 are in connection with each other.

Approach position limitation surfaces 122 and 123 configured to limit maximum approach positions of the operational arms 100 are correspondingly provided below the tooth-shaped portions 111 and 121 of the operational arms 100. When the one operational arm 110 and the other operational arm 120 rotate around the rotational shafts 331 in a direction to approach each other, they may rotate to a position where the approach position limitation surfaces 122 and 123 located below the tooth-shaped portions 111 and 121 come into contact with each other.

Rotation restriction protrusions 124 and 125 configured to regulate rotational ranges of the operational arms 100 may be provided above the tooth-shaped portions 111 and 121. When the force applied to the operational arms 100 is removed, the operational arms 100 are spaced apart from each other at positions corresponding to the released state of the gas springs 200 due to restoration of the gas springs 200. The positions correspond to maximum spaced positions of the operational arms 100.

When the operational arms 100 are located at the maximum spaced positions, the rotation restriction protrusions 124 and 125 come into contact with each other so as to prevent the operational arms 100 from being additionally spaced apart beyond the maximum spaced positions due to tensioning of the gas springs 200 by the user. By preventing additional tensioning of the gas springs 200, malfunctioning of the gas springs 200 may be prevented and the operational arms 100 may be stably retained at the maximum spaced positions without a gap.

A fixing arm 360 may be installed on the head 300 to be interposed between the front plate 310 and the rear plate 320 above the upper ends of the operational arms 100.

The fixing arm 360 is disposed so that fixing ends 361 and 362 located on both ends of the fixing arm 360 come into contact with the upper ends of the operational arms 100 at the maximum spaced positions of the operational arms 100. Accordingly, the operational arm 100 may be prevented from additionally rotating and passing the maximum spaced positions. Also, the fixing arm 360 is disposed at the maximum approach position to come into contact with the rotation restriction protrusions 124 and 125. Surfaces, opposite to surfaces of the rotation restriction protrusions 124 and 125 which face each other, come into contact with the rotation restriction protrusions 124 and 125. Accordingly, the rotation restriction protrusions 124 and 125 are allowed to support the operational arms 100 at the maximum approach positions with the approach position limitation surfaces 122 and 123. As described above, the fixing arm 360 may support the operational arms 100 at the maximum spaced positions and the maximum approach position and improve durability of the chest expander by dispersing impact applied to the operational arms 100 at the maximum spaced positions and the maximum approach positions. The fixing arm 360 also performs a function of stably retaining the installation space in the head 300 by supporting a gap between the front plate 310 and the rear plate 320.

Although the embodiment of the present invention exemplifies a form including all of the approach position limitation surfaces 122 and 123, the rotation restriction protrusions 124 and 125, and the fixing arm 360, a method of supporting positions of the operational arms 100 at the maximum spaced positions and the maximum approach positions may be selectively employed.

When the user moves the one operational arm 110 and the other operational arm 120 at the maximum spaced positions of the operational arms 100 corresponding to the released state of the gas springs 200 to approach each other by applying a force thereto, the gas springs 200 are compressed and provide forces disturbing compressive deformation to the operational arms 100. When the one operational arm 110 and the other operational arm 120 move to the maximum approach positions and the user removes the force applied to the operational arms 100, the one operational arm 110 and the other operational arm 120 rotate around the rotational shafts 331 in reverse directions and return to the maximum spaced positions due to restoration of the gas springs 200. The user may exercise by repeatedly moving the operational arms 100 between the maximum spaced positions and the maximum approach positions.

The chest expander according to the present invention is configured to adjust intensity of elastic force by including holding devices 400 configured to fix the upper ends of the gas springs 200 installed to be movable along the longitudinal holes 140 at adjusted positions. Accordingly, the intensity of elastic force of the chest expander may be adjusted according to muscular strength of the user.

According to the embodiment of the present invention, guides 510 coupled to the top ends of the gas springs 200 are disposed in the longitudinal holes 140. The guides 510 move along the longitudinal holes 140 so as to adjust the positions of the upper ends of the gas springs 200.

Coupling shafts 250 extend from the upper ends of the operational arms 100 in directions of intersecting with extension directions of the operational arms 100 and are coupled to holes of the guides 510 so as to couple the upper ends of the operational arms 100 to the guides 510. However, the guides 510 are not limited thereto and may be formed to have a variety of forms. For example, the coupling shafts 250 extending from the upper ends of the operational arms 100 themselves may be the guides 510 and may include a plurality of components such as first guides connected to the coupling shafts 250 and second guides coupled to support plates 520 and 530. The guides 510 are defined as elements disposed in the longitudinal holes 140 to move with the upper ends of the gas springs 200.

The holding devices 400 are coupled to the guides 510 and fix the guides 510 to selected positions in the longitudinal holes 140 so as to adjust intensity.

Referring to FIGS. 2 and 3, sawteeth 150 are formed on upper outer surfaces of the operational arms 100 corresponding to the positions of the longitudinal holes 140.

The holding devices 400 include poles 410 including contact portions 411 engaged with the sawteeth 150. The contact portions 411 include a shape corresponding to the sawteeth 150.

The poles 410 are formed to have engagement positions at which the contact portions 411 are engaged with the sawteeth 150 and disengagement positions at which the contact portions 411 are spaced apart from the sawteeth 150 and to be movable between the engagement positions and the disengagement positions. The poles 410 are disposed to come into contact with the sawteeth 150 at the engagement positions. The number of sawteeth 150 forms elastic force adjustment stages. According to the embodiment of the present invention, the sawteeth 150 include ten sawteeth so that levels of intensity of elastic force may be adjusted into ten stages.

According to the embodiment of the present invention, the holding devices 400 include elastic support members 420 configured to support the poles 410 at the engagement positions. Also, the holding devices 400 include the support plates 520 and 530 configured to support the poles 410 and the elastic support members 420 therebetween. The support plates 520 and 530 of the holding devices 400 are coupled to be movable with respect to the operational arms 100.

According to the present invention, the sawteeth 150 are formed to be ratchet sawteeth formed to be tilted in one direction. A ratchet is a tool including a ratchet gear having ratchet sawteeth and a pole and allowing only unidirectional movement of the ratchet gear while the ratchet gear is engaged with the pole. Here, the ratchet sawteeth 150 and the poles 410 of the chest expander according to the present invention employ this principle of well-known ratchets. Accordingly, the ratchet sawteeth 150 allow the poles 410 to move along the ratchet sawteeth 150 even when the poles 410 are at the engagement positions.

According to the embodiment of the present invention, the ratchet sawteeth 150 are formed along outer surfaces of the operational arms 100 to be tilted downward in a top-bottom direction. Accordingly, while the poles 410 are engaged with the ratchet sawteeth 150, it is possible to adjust intensity of the chest expander by downward movement of the holding devices 400 instead of moving the poles 410 to the disengagement positions. Accordingly, the intensity may be more easily adjusted.

While the operational arms 100 approach each other, the gas springs 200 may apply a force in a direction to lift the holding devices 400. However, according to the embodiment of the present invention, since the ratchet's sawteeth 150 only allow the poles 410 to move downward while the poles 410 are engaged, the holding devices 400 are prevented from moving during exercise using the chest expander. In a modified example in which the upper ends of the gas springs 200 are fixed by pivoting shafts and the lower ends of the gas springs 200 are formed to be movable along the longitudinal holes, the ratchet sawteeth 150 may be formed to be tilted upward to allow upward movement of the poles 410 and to prevent downward movement of the poles 410 while the poles 410 are engaged.

According to the embodiment of the present invention, the poles 410 are rotatably installed on first shafts 430 between the support plates 520 and 530. In the present invention, positions at which the poles 410 are rotated around the first shafts 430 to be engaged with the ratchet sawteeth 150 will be referred to as the engagement positions of the poles 410 (refer to FIG. 4) and positions at which the poles 410 are rotated in an opposite direction around the first shafts 430 to be detached from the ratchet sawteeth 150 will be referred to as the disengagement positions of the poles 410 (refer to FIG. 5). The poles 410 are rotatably installed between the engagement positions and the disengagement positions on the basis of the first shafts 430.

The poles 410 may include rotational knobs 412 configured to manipulate the poles 410 to rotate along the first shafts 430. Due to an operation of the user holding and rotating the rotational knobs 412, the poles 410 may be rotated between the engagement positions and the disengagement positions.

The elastic support members 420 elastically support the poles 410 to allow the poles 410 to remain at the engagement positions. That is, the elastic support members 420 are installed to pressurize the poles 410 in a direction in which the contact portions 411 of the poles 410 come into contact with the ratchet sawteeth 150.

According to the embodiment of the present invention, the elastic support members 420 are installed to support the poles 410 at both the engagement positions and disengagement positions of the poles 410.

The elastic support members 420 include contact support portions 421, springs 422, and shaft connection portions 423. The contact support portions 421 are installed to be movable in a longitudinal direction with respect to the shaft connection portions 423, and the springs 422 are installed therebetween. The springs 422 pressurize the contact support portions 421 outward in a longitudinal direction.

In the elastic support members 420, the shaft connection portions 423 are pivotably installed on second shafts 440 located below the first shafts 430 between the support plates 520 and 530, and the contact support portions 421 come into contact with one side surfaces of the poles 410 and support the poles 410 at the engagement positions and the disengagement positions. Ends of the contact support portions 421 come into contact with side surfaces of the poles 410 which face the elastic support members 420.

In detail, in a contact relationship between ends of the contact support portion 421 and the poles 410, contact surfaces 413 formed as arc-shaped grooves are provided in one side surfaces of the poles 410 which face the elastic support members 420 at points with which the ends of the contact support portions 421 come into contact. Protrusions 421*a* corresponding to the grooves may be formed at the ends of the contact support portions 421 of the elastic support members 420. The contact surfaces having an arc-shaped groove shape are located at the engagement positions of the poles 410 outside lines connecting the first shafts 430 to the second shafts 440 (refer to FIG. 4). Accordingly, at the engagement positions, when the contact support portions 421 pressurize the poles 410, the contact portions 411 of the poles 410 are pressurized in a direction of coming into contact with the ratchet sawteeth 150. The elastic support members 420 pressurize the poles 410 to remain at the engagement positions.

Figure 5:
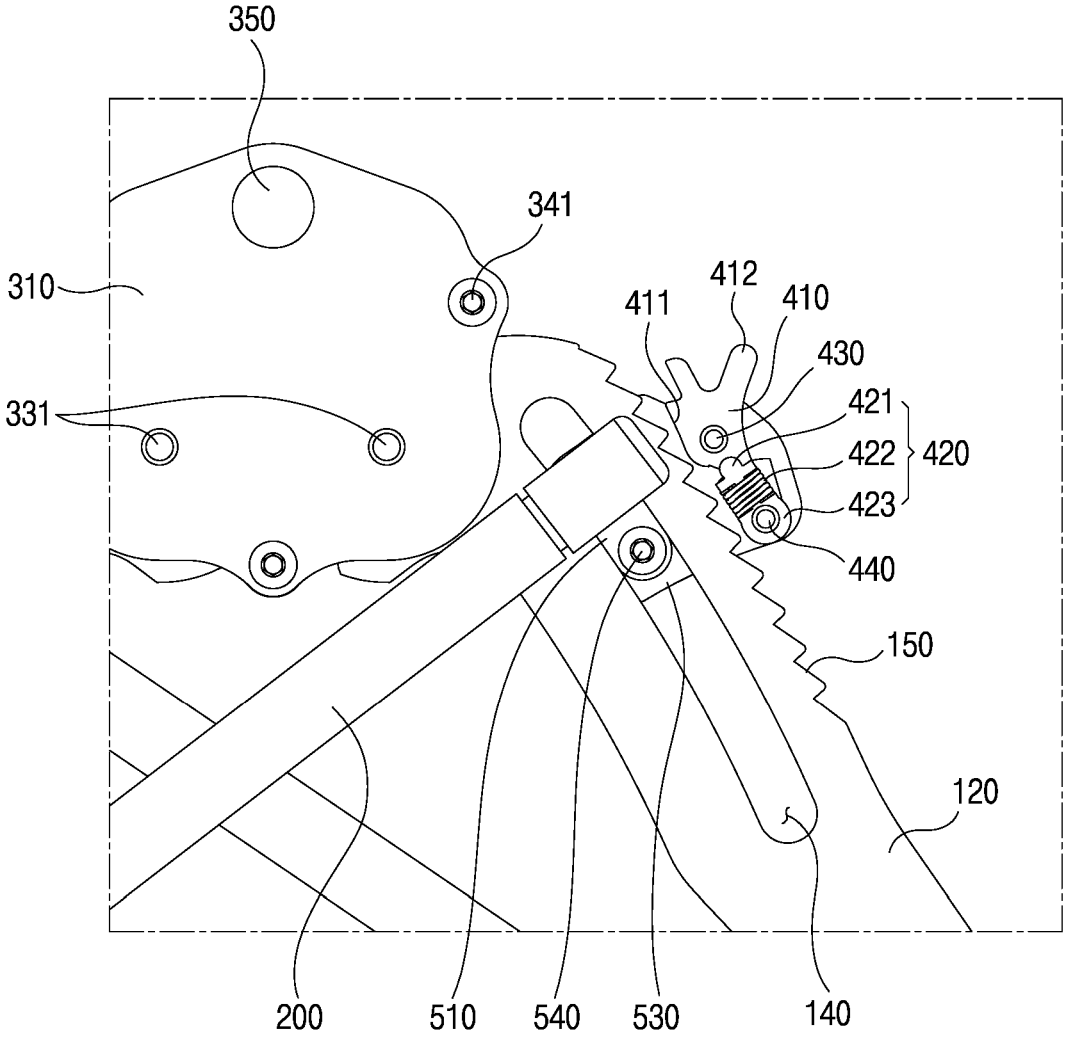
FIG. 5 is a view illustrating a state in which the poles are disposed at disengagement positions in the holding devices of the chest expander according to the present invention.

When the poles 410 rotate along the first shafts 430 and move to the disengagement positions due to the rotational knobs 412, the contact surfaces having the arc-shaped groove shape are located on or inside the lines connecting the first shafts 430 to the second shafts 440 (refer to FIG. 5). Accordingly, at the disengagement positions, when the contact support portions 421 pressurize the poles 410, the contact portions 411 of the poles 410 are pressurized in a direction of being spaced apart from the ratchet sawteeth 150. The elastic support members 420 pressurize the poles 410 to remain at the disengagement positions. The contact surfaces 413 having the arc-shaped groove shape and the protrusions 421*a* function as contact hinges between the poles 410 and the elastic support members 420.

Accordingly, when the poles 410 are located at the engagement positions where the contact portions 411 of the poles 410 are engaged with the ratchet sawteeth 150 by pushing the rotational knobs 412, the elastic support members 420 pivot around the second shafts 440 in a direction outward from the ratchet sawteeth 150 so as to provide elastic support forces to the poles 410. In this state, when the user moves the holding devices 400 downward by applying a force thereto, the holding devices 400 move downward with the upper ends of the gas springs 200 so that intensity is adjusted. Since the poles 410 still remain in a state of being pressurized toward the engagement positions due to the elastic support members 420, the holding devices 400 may support the upper ends of the gas springs 200 while being adjusted in positions.

The ratchet sawteeth 150 allow the holding devices 400 including the poles 410 to only move downward. In order to move the holding devices 400 upward, the user may move the poles 410 to the disengagement positions where the contact portions 411 are detached from the ratchet sawteeth 150 by pulling the rotational knobs 412 and may move the holding devices 400 upward.

According to the present invention, since increasing intensity by moving the holding devices 400 downward is possible by simply pulling and moving the holding devices 400 downward while the poles 410 are engaged with the ratchet sawteeth 150, the intensity may be very easily adjusted. Also, when it is intended to adjust the intensity to be low, adjustment may be performed while the poles 410 are moved to the disengagement positions by pulling the rotational knobs 412.

The holding devices 400 are integrally connected to the upper ends of the gas springs 200 and the guides 510 by the support plates 520 and 530.

The support plates 520 and 530 are disposed on the front surfaces and rear surfaces of the operational arms 100 with the operational arms 100 interposed therebetween. The operational arms 100, the poles 410, the elastic support members 420, and the guides 510 are interposed between the support plates 520 and 530.

The coupling shafts 250 of the operational arms 100 pass through the support plates 520 and 530 and are coupled to the guides 510. Also, fastening members 540 configured to fix the support plates 520 and 530 to the guides 510 are fastened. Also, the first shafts 430 and the second shafts 440 are installed on the support plates 520 and 530.

Rotation limitation holes 450 configured to limit and guide rotation of the elastic support members 420 are formed in the support plates 520 and 530. Since side surfaces of the springs 422 of the elastic support members 420 protrude inside the rotation limitation holes 450, the rotation of the elastic support members 420 is limited within ranges of the rotation limitation holes 450 due to interference of the springs 422 and the rotation limitation holes 450. The rotation limitation holes 450 guide the elastic support members 420 to rotate within set rotation ranges and prevent the elastic support members 420 from being detached from set positions.

An operation of the holding devices 400 of the chest expander according to the present invention will be described below with reference to the attached drawings.

Figure 4:
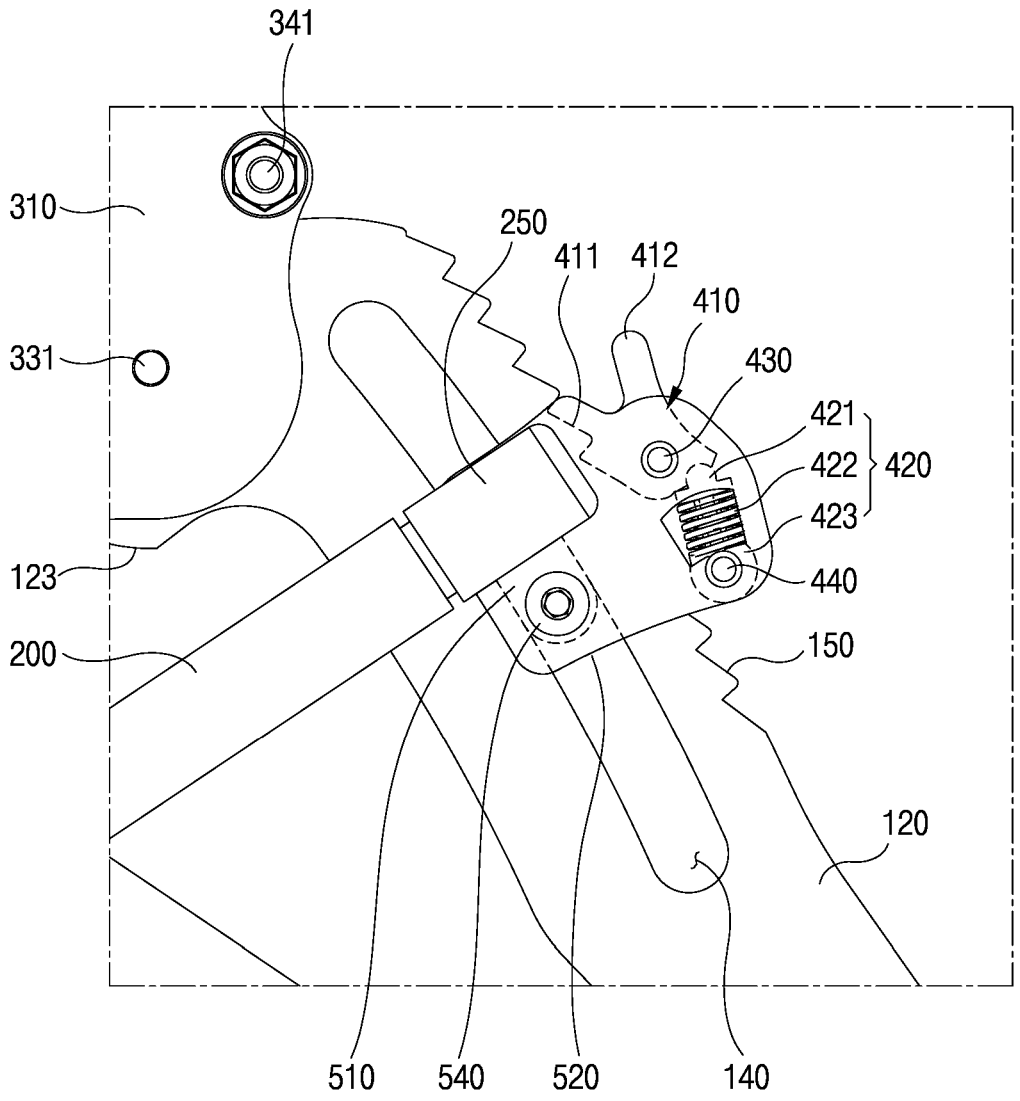
FIG. 4 is a view illustrating a state in which poles are disposed at engagement positions in holding devices of the chest expander according to the present invention.
Figure 6:
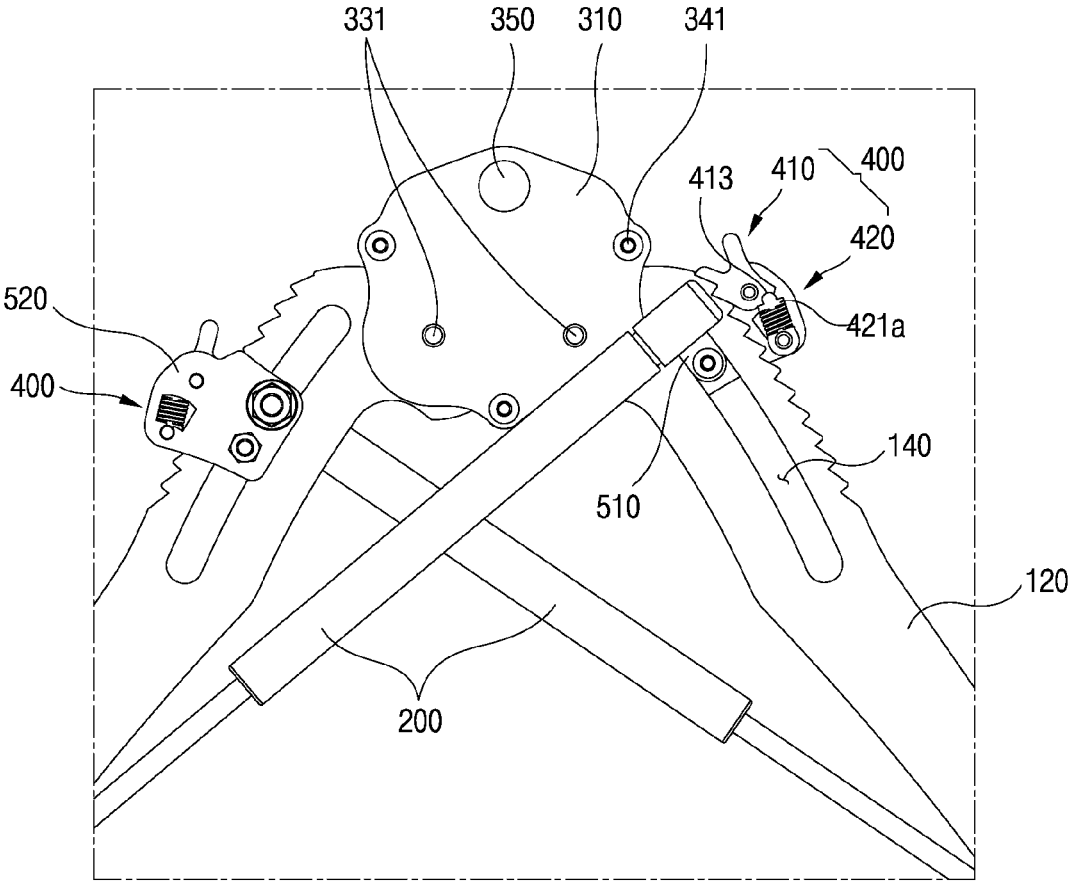
FIG. 6 is a view illustrating a state in which intensity of the chest expander according to the present invention is adjusted to be lowest.
Figure 7:
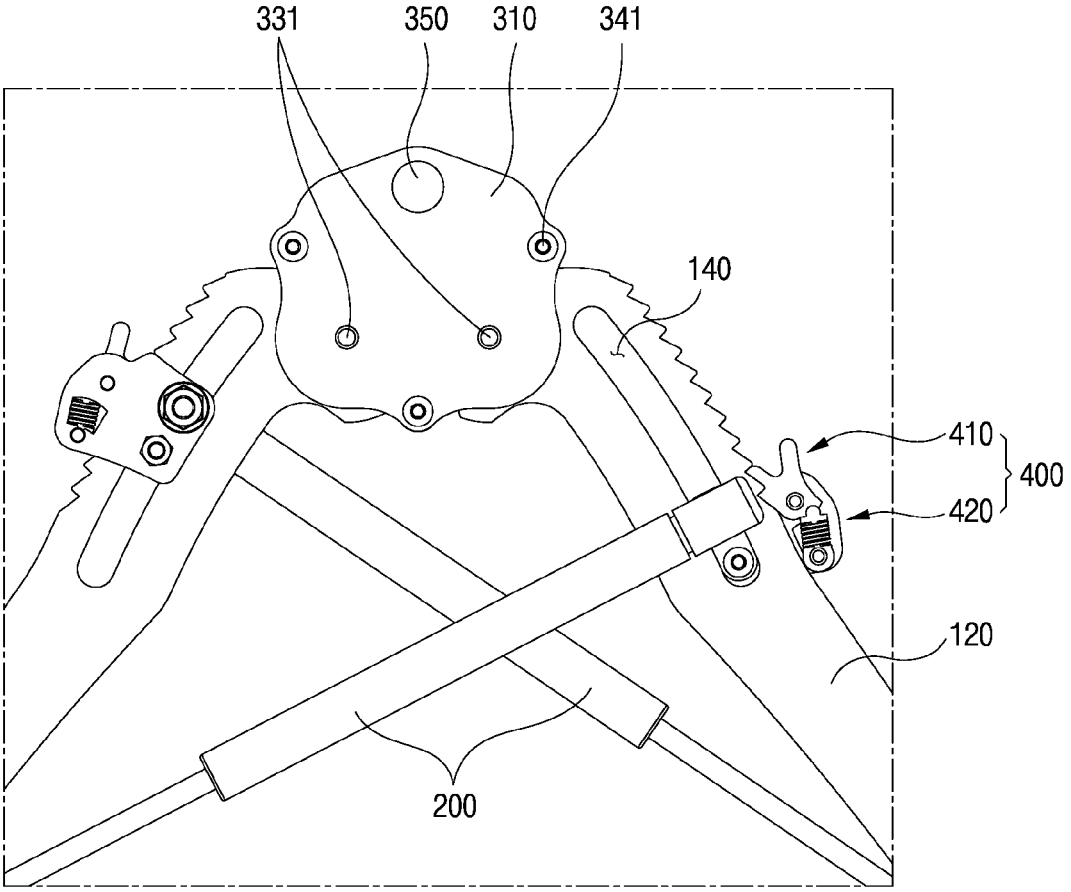
FIG. 7 is a view illustrating a state in which the intensity of the chest expander according to the present invention is adjusted to be highest.

FIG. 4 is a view illustrating a state in which the poles are disposed at the engagement positions in the holding devices of the chest expander according to the present invention, and FIG. 5 is a view illustrating a state in which the poles are disposed at the disengagement positions in the holding devices of the chest expander according to the present invention. Also, FIG. 6 is a view illustrating a state in which intensity of the chest expander according to the present invention is adjusted to be lowest, and FIG. 7 is a view illustrating a state in which the intensity of the chest expander according to the present invention is adjusted to be highest.

Referring to FIG. 4, while the contact portions 411 of the poles 410 of the holding devices 400 are engaged with the ratchet sawteeth 150, intensity is adjustable in a direction of increasing the intensity without moving the poles 410 to the disengagement positions. When the user holds and pulls the holding devices 400 downward, the contact portions 411 of the poles 410 move along the ratchet sawteeth 150. Here, the guides 510 move downward along the longitudinal holes 140 with the upper ends of the gas springs 200. Since the elastic support members 420 push the poles 410 to the engagement positions, the poles 410 remain in an engaged state at the adjusted positions after the poles 410 move along the ratchet sawteeth 150. Accordingly, the intensity may be easily adjusted in a direction of increasing the intensity.

Referring to FIG. 5, in order to move the holding devices 400 upward, it is necessary to move the poles 410 to the disengagement positions. When the rotational knobs 412 of the poles 410 are rotated outside the ratchet sawteeth 150, the poles 410 rotate around the first shafts 430 and the elastic support members 420 retain the poles 410 at the disengagement positions. Accordingly, the user may hold the holding devices 400 and move the guides 510 and the upper ends of the gas springs 200 upward along the longitudinal holes 140.

As a modified example, when the sawteeth 150 formed in the operational arms 100 are not ratchet sawteeth which allow unidirectional movement of the poles 410, the poles 410 may be moved to the disengagement positions using the rotational knobs 412 and then positions of the upper ends of the gas springs 200 may be adjusted. After the positions of the upper ends of the gas springs 200 are adjusted, the poles 410 may be moved to the engagement positions using the rotational knobs 412 and fixed to adjusted positions.

As described above, the positions of the upper ends of the gas springs 200 with respect to the longitudinal holes 140 may be adjusted so as to adjust intensity of the gas springs 200 according to the muscular strength of the user.

While adjusting the intensity, as shown in FIG. 6, the intensity of elastic force becomes lowest when the positions of the upper ends of the gas springs 200 correspond to positions of upper ends of the longitudinal holes 140. When exercise is executed while the operational arms 100 approach each other, displacement in which the gas springs 200 are compressed is smallest. As shown in FIG. 7, the intensity of elastic force becomes highest when the positions of the upper ends of the gas springs 200 correspond to positions of lower ends of the longitudinal holes 140. When exercise is executed while the operational arms 100 approach each other, displacement in which the gas springs 200 are compressed is greatest. The number of stages of intensity of the chest expander corresponds to the number of the sawteeth 150.

According to the chest expander according to the present invention, at the maximum spaced positions of the operational arms 100 which are exercise-start positions, the positions of the upper ends of the gas springs 200 with respect to the longitudinal holes 140 are adjusted so as to adjust the intensity of the chest expander. Accordingly, the user may exercise while adjusting the intensity of the chest expander according to user's power.

As described above, in a chest expander according to the present invention, positions of one ends of gas springs are moved along longitudinal holes so as to allow a user to easily adjust intensity of elastic force provided by the chest expander according to user's muscular strength.

The above description of the present invention is merely an example, and it should be understood that a variety of modifications in other detailed shapes may be easily made by one of ordinary skill in the art without changing technical concept or essential features of the present invention. Therefore, it should be understood that the above-described embodiments are exemplary and not limitative in every aspect. The scope of the present invention will be defined by the following claims, and it should be construed that all changes or modifications derived from the meaning and the scope of the claims and equivalents thereof are included in the scope of the present invention.

What is claimed is:

1. A chest expander comprising:

a head;

a pair of operational arms each having upper ends coupled to the head by rotational shafts and configured to move to approach or be spaced apart from each other;

a pair of gas springs each disposed crosswise between the pair of operational arms and configured to provide elastic forces in a direction in which the pair of operational arms are spaced apart from each other;

a longitudinal hole formed in each operational arm of the pair of operational arms to guide one end of each gas spring of the pair of gas springs to move along a longitudinal direction of the respective operational arm;

a guide coupled to the one end of each gas spring of the pair of gas springs and configured to be movable along the longitudinal hole; and a holding device connected to each of the guides, the holding device including a pole engaged with a sawteeth formed on an outer side of each operational arm of the pair of operational arms to hold the respective guide at a selected position in the longitudinal hole, wherein intensity of elastic force provided by each gas spring of the pair of gas springs is adjusted by adjusting position of the one end of each gas spring of the pair of gas springs by moving the respective guide along the longitudinal hole.

2. The chest expander of claim 1, wherein each of the holding devices comprises:

a support plate arranged to be movable along the respective operational arm and connected to the respective guide;

the pole arranged on the respective support plate, including a contact portion engaged with the respective sawteeth, and configured to be movable between an engagement position at which the contact portion is engaged with the respective sawteeth and a disengagement position at which the contact portion is detached from the respective sawteeth; and an elastic support member arranged on the respective support plate and configured to elastically support the respective pole to retain the respective pole at the engagement position.

3. The chest expander of claim 2, wherein a first shaft on which the respective pole is rotatably coupled and a second shaft on which the respective elastic support member is rotatably coupled are provided on the s respective support plate, wherein each of the poles comprises a contact surface, with which an end of the respective elastic support member comes into contact, on a surface facing the respective elastic support member, and wherein the respective elastic support member rotates in accordance with a rotation of the respective pole and a direction in which the end of the respective elastic support member pressurizes the contact surface of the respective pole is changed so that the respective pole can be supported at the engagement position and the disengagement position by the respective elastic support member.

4. The chest expander of claim 3, wherein each of the poles comprises a rotational knob configured to rotate the respective pole between the engagement position and the disengagement position.

5. The chest expander of claim 4, wherein a rotation limitation hole, through which a portion of the respective elastic support member protrudes, is formed in each of the support plates, and each of the rotation limitation hole guides the respective elastic support member to be rotated within a set range.

6. The chest expander of claim 3, wherein each of the elastic support members comprises a shaft connection portion rotatably coupled on the respective second shaft, a contact support portion arranged to be movable in a longitudinal direction with respect to the shaft connection portion and having an end coming into contact with the contact surface of the respective pole, and a spring disposed between the shaft connection portion and the contact support portion.

7. The chest expander of claim 2, wherein the sawteeth are formed to be a ratchet sawteeth tilted in one direction and configured to allow the respective pole to move in one direction while the respective pole is supported at the engagement position by the respective elastic support member.

8. The chest expander of claim 1, wherein a tooth-shaped portion is formed on an outer circumferential surface of each of the upper ends of the pair of operational arms and the tooth-shaped portions of the pair of operational arms are arranged to rotate while being engaged with each other.

9. The chest expander of claim 1, wherein the longitudinal hole is formed along a rotational path of the one end of each gas spring of the pair of gas springs around an other end of each gas spring of the pair of gas springs while the respective gas spring is in a released state.

* * * * *